US005266916A

United States Patent [19]

Kijima

[11] Patent Number: 5,266,916

[45] Date of Patent: Nov. 30, 1993

[54] COMPACT TRANSFORMER

[75] Inventor: Seiichi Kijima, Tokyo, Japan

[73] Assignee: Kijima Co., Ltd., Tokyo, Japan

[21] Appl. No.: 489,702

[22] Filed: Mar. 7, 1990

Related U.S. Application Data

[62] Division of Ser. No. 317,195, Feb. 28, 1989, Pat. No. 4,931,761.

[30] Foreign Application Priority Data

Mar. 8, 1988 [JP] Japan ..... 63-52747

[51] Int. Cl.[5] ..... H01F 27/26; H01F 27/30

[52] U.S. Cl. ..... 336/160; 336/182; 336/192; 336/198; 336/212

[58] Field of Search ..... 336/198, 208, 160, 165, 336/5, 192, 10, 212, 12, 170, 180, 182, 181, 210, 83

[56] References Cited

U.S. PATENT DOCUMENTS

| | | | |
|---|---|---|---|
| 600,228 | 3/1898 | Kurda | 336/5 |
| 1,227,415 | 5/1917 | Fortescue | 336/215 |
| 1,870,038 | 8/1932 | Carlson | 336/165 |
| 2,317,844 | 4/1943 | Boucher et al. | 336/165 |
| 2,352,073 | 6/1944 | Boucher et al. | 336/165 |
| 2,561,855 | 7/1951 | Gould | 336/165 |
| 2,644,107 | 6/1953 | Keiffer et al. | 336/165 X |
| 3,076,136 | 1/1963 | Moerlein | 336/165 |
| 3,531,708 | 9/1970 | Kuba | 336/215 |
| 4,419,814 | 12/1983 | Hasserjian | 336/198 |
| 4,721,935 | 1/1988 | Gunnels et al. | 336/198 |
| 4,730,178 | 3/1988 | Gunnels et al. | 336/165 X |

FOREIGN PATENT DOCUMENTS

| | | | |
|---|---|---|---|
| 1110299 | 7/1961 | Fed. Rep. of Germany | 336/5 |

*Primary Examiner*—Thomas J. Kozma

*Attorney, Agent, or Firm*—Spensley, Horn, Jubas & Lubitz

[57] ABSTRACT

Here is disclosed a compact transformer comprising a plurality of core elements so combined to form a complete core defining two closed magnetic circuits, one of these magnetic circuits being provided with primary and secondary windings of a first coil and the other magnetic circuit being provided with primary and secondary windings of a second coil so that inductive portions of these first and second coils are simultaneously activated.

17 Claims, 15 Drawing Sheets

COMPACT TRANSFORMER

This is a division of application Ser. No. 07/317,195, now U.S. Pat. No. 4,931,761 filed on Feb. 28, 1989.

FIELD OF THE INVENTION

This invention relates to a compact transformer for use in various electric equipments and devices including general electric communication systems and photographic flash discharge lamp.

BACKGROUND ART

There have already been developed various types of such compact transformer and one such compact transformer generally designated here as 11 is shown by way of example in FIG. 23 of the accompanying drawing, in which reference numerals 12, 13 designate identical E-shaped core elements made of ferrite. Leg ends of these core elements opposed to each other are abutted and fixed together so as to form respective closed magnetic circuits 14, 15. Reference numeral 16 designates a coil of low-tension side and reference numeral 17 designates a coil of high-tension. These coils are wound around central legs of the respective core elements 12, 13. It should be understood that there may be provided a certain gap between the respective central legs of said core elements 12, 13. Concerning the manner of coil winding, the respective coils 16, 17 are typically wound around tubular portions of associated bobbins into which the central legs of the respective core elements 12, 13 are inserted.

FIG. 24 is a circuit diagram of the photographic flash discharge device incorporated with the above-mentioned compact transformer 11. As seen in this circuit diagram, the compact transformer 11, oscillation transistors 18, 19, a resistor 20 forming a timer together with a capacitor 21, and a diode 22 altogether form a DC-DC converter adapted to boost DC voltage of a source battery 24 connected to the low-tension side and to provide output voltage used to charge a main capacitor 23.

The circuit arrangement of FIG. 24 further includes a neon lamp 25 adapted to be put on when the main capacitor 23 has been charged up to a predetermined voltage, a trigger circuit 26, a xenon discharge tube 27, stabilizing capacitors 28, 29, a diode 30 to protect oscillation transistors 18, 19 and a source switch 31.

FIG. 25 is a circuit diagram showing details of said trigger circuit 26. Referring to FIG. 25, upon closure of a trigger switch 32 in operative association with opening of the camera shutter, a trigger capacitor 33 is discharged through a primary coil of a trigger transformer 34 and a high voltage simultaneously generated across a secondary coil of said transistor 34 is applied to an exciting electrode of the xenon discharge tube.

It is important for the above-mentioned compact transformer 11 to minimize its outer dimension but to maximize its capabilities.

For example, when used in the photographic flash discharge device as shown in FIG. 24, the compact transformer 11 should effectively reduce a necessary space within the device for building-in of this transformer 11 and achieve a time for charging of the main capacitor 23 as short as possible. The compact transformer 11 used in such application usually generates heat of a considerable high temperature and may often lead not only to dielectric breakdown of the transformer itself but also to heating of various circuit components therearound.

This problem of heat generation will be serious especially when the flash discharge lamp device is built in the photographic camera, since said compact transformer 11 must be incorporated together with the associated circuit components within a limited space available in the camera.

SUMMARY OF THE INVENTION

It is an object of the invention to improve conversion efficiency of a compact transformer.

It is another object of the invention to reduce heat generation to a level as low as possible.

It is still another object of the invention to facilitate mounting of the transformer by reducing a space necessary for mounting.

Reduction of heat generation is achieved according to the invention by combining a plurality of core elements to form a complete core defining two closed magnetic circuits of which the one is provided with primary and secondary windings of a first coil and the other is provided with primary and secondary windings of a second coil so that inductive portions of said first and second coils are simultaneously activated.

Improvement of conversion efficiency is achieved, in accordance with the teachings of the instant invention, by combining a plurality of core elements to form a complete core defining two closed magnetic circuits of which the one is provided with primary and secondary windings of a first coil and the other is provided with primary and secondary windings of a second coil, wherein the respective primary windings of said first and second coils are connected to each other while the respective secondary windings of said first and second coils are connected to each other.

Facilitation of mounting is achieved, according to the teachings of this invention, by providing an improved arrangement comprising a bobbin having a square tubular portion serving as a coil carrier provided at opposite ends with respective end flanges and at middle with an intermediate flange, these flanges being formed integrally with said square tubular portion, said intermediate flange including a channel in communication with the interior of said square tubular portion to receive one of core elements; a first coil wound around said square tubular portion along a first coil carrying section defined between one of said end flanges and the intermediate flange and a second coil wound around said square tubular portion along a second coil carrying section defined between the other of said end flanges and the intermediate flange; and a core consisting of two core elements partially inserted into the interior of said square tubular portion of the bobbin from the exterior through the respective end flanges and another core element inserted into said channel formed in said intermediate flange of the bobbin.

DESCRIPTION OF THE PREFERRED EMBODIMENT

The invention will be described more in detail, by way of example, in reference with the accompanying drawing.

Figure 1:
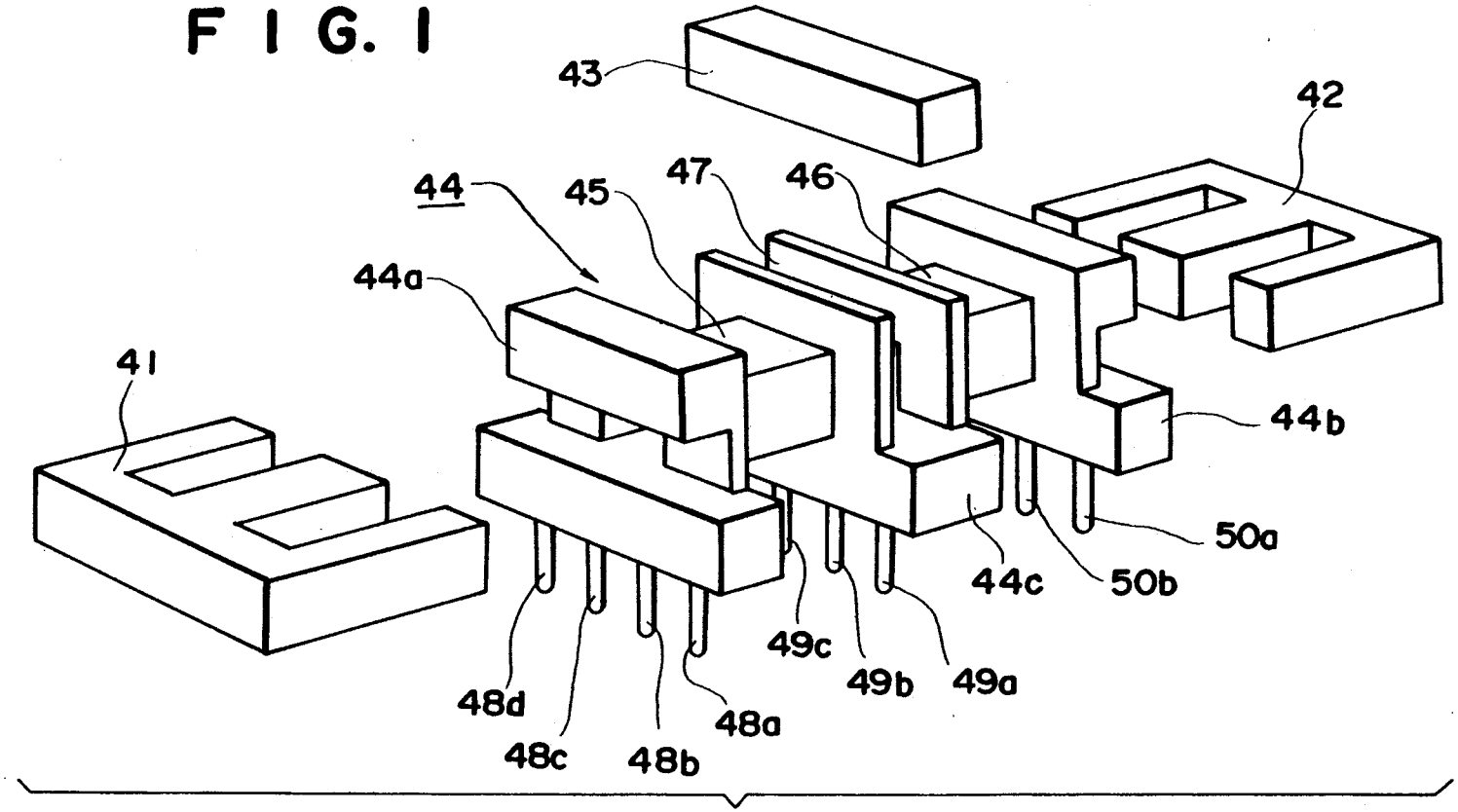
FIG. 1 is an exploded perspective view of a core/bobbin assembly in a first embodiment of the transformer constructed according to the invention.
Figure 2:
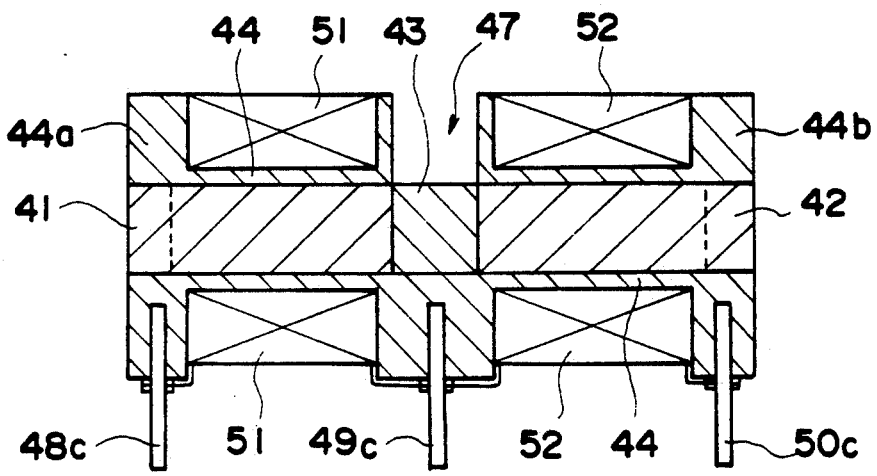
FIG. 2 is a vertical sectional view of the transformer constructed as the first embodiment of the invention.
Figure 3:
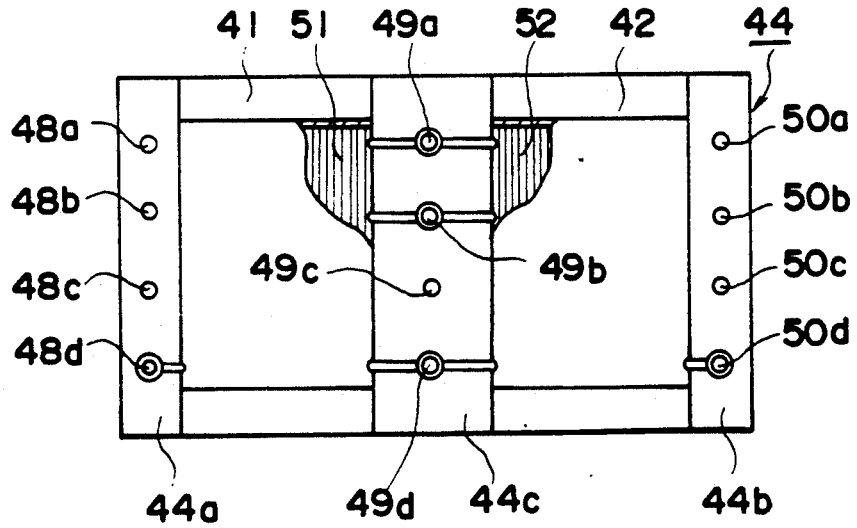
FIG. 3 is a bottom view of said transformer.

FIG. 1 is an exploded perspective view of a core/-bobbin assembly in a first embodiment of the compact transformer constructed in accordance with the teachings of this invention, FIG. 2 is a vertical sectional view of this compact transformer, and FIG. 3 is a bottom view thereof.

Referring to these figures, reference numerals 41, 42 designate identical E-configuration core elements made of ferrite and reference numeral 43 designates an I-configuration core elements of the same material.

Reference numeral 44 designates a bobbin made of plastic material, which comprises a square tubular portion serving as a coil carrier provided at opposite ends with respective end flanges 44*a*, 44*b* and at the middle with an intermediate flange 44*c* so as to define a first coil carrying section 45 and a second coil carrying section 46 along the square tubular portion of the bobbin 44.

The intermediate flange 44*c* of this bobbin 44 is formed with, as shown, a slit-like groove or channel 47 to receive the I-configuration core element 43. The channel 47 has a width substantially same as a plate thickness of the I-core element 43 and a depth extending to a level corresponding to the bottom wall of the interior of the square tubular portion so that said channel 47 is in communication with the interior of said square tubular portion.

The one end flange 44*a* has planted thereon terminal pins 48*a* through 48*d*, the intermediate flange 44*c* has planted thereon terminal pins 49*a* through 49*d*, and the other end flange 44*b* has planted thereon terminal pins 50*a* through 50*d*.

Figure 4:
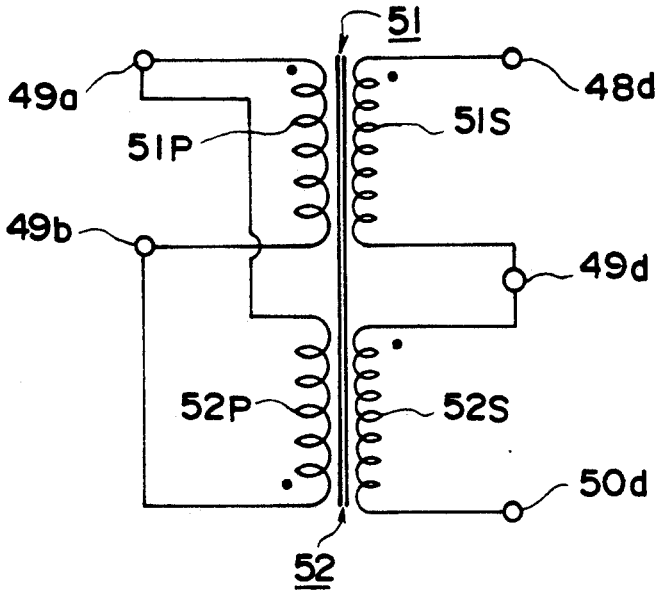
FIG. 4 and 5 are diagrams respectively showing, by way of example, circuit arrangements which may be used by said transformer.

Production of the above-mentioned transformer is initiated with coil loading on the bobbin 44 previously provided with the terminal pins planted thereon. Operation of such coil loading is, for example, performed as follows. As shown by FIG. 4, after a leading end has been anchored on the terminal pin 48*d*, a length of wire is wound around the first coil carrying section 45 by a predetermined turns to form the secondary winding 51S of a first coil 51 and then a trailing end of this winding is anchored on the terminal pin 49*d*.

Without cutting wire following fixation of the trailing end of said secondary winding 51S on said terminal pin 49*d*, another length of wire is wound around the second coil carrying section 46 by a predetermined turns to form a secondary winding 52S of a second coil 52 and a trailing end of this winding is anchored on the terminal pin 50*d*, followed by cutting wire.

Then, a leading end of still another length of wire to be formed into secondary windings is anchored on the terminal pin 49*a*, thereafter on portion of this length is wound around the first coil carrying section 45 by a predetermined turns to form a primary winding 51P of the first coil 51 and a trailing end of this primary winding 51P is anchored on the terminal 49*b* without cutting wire. Then, another portion of said length is wound around the first coil carrying section 45 by a predetermined turns to form a primary winding 51P of the first coil 51 and a trailing end thereof is anchored on the terminal pin 49*b*, leaving a further length of wire without being cut. Then, another portion of said length is wound around the second coil carrying section 46 by a predetermined turns to form a primary winding 52P of the second coil 52 and a trailing end thereof is anchored on the terminal pin 49*a*, followed by cutting of wire.

A series of operations as described above is carried out by an automatic winding machine and, upon completion of winding operations, the respective coil ends anchored on the associated terminal pins are fixed thereto by means of soldering. The manner of winding as has been described results in formation of the first coil 51 and the second coil 52 as seen in the circuit diagram of FIG. 4.

The E-core element 41 is inserted with its central leg into the square tubular portion of the bobbin 44 from the exterior through the end flange 44*a* and, similarly, the E-core element 42 is inserted with its central leg into the square tubular portion of the bobbin 44 from the exterior through the end flange 44*b*.

It should be noted here that, if necessary, suitable insulating means such as insulating tape may be interposed between the primary winding 51P and the secondary winding 51S of the first coil 51, and between the primary winding 52P and the secondary winding 52S of the second coil 52, or may be wound around the outer periphery of each coil. h The I-core element 43 is inserted into the channel 47 of the intermediate flange 44c and joined to the leg end surfaces of the respective E-core elements 41, 42. More specifically, the respective leg end surfaces of the E-core element 41 are abutted and joined to one surface of the I-core element 43 by means of suitable adhesive and the respective leg end surfaces of the E-core element 42 are similarly joined to the opposite surface of the I-core element 43.

Implementation of this invention does not necessarily require employment of the specific circuit arrangement as shown by FIG. 4. For example, the primary windings 51P, 52P may be connected in series with each other or the secondary windings 51S, 52S may be connected in parallel with each other. Further, the first coil 51 and the second coil 52 may be separately formed rather than forming them by the continuous winding fashion as has previously been mentioned.

Figure 5:
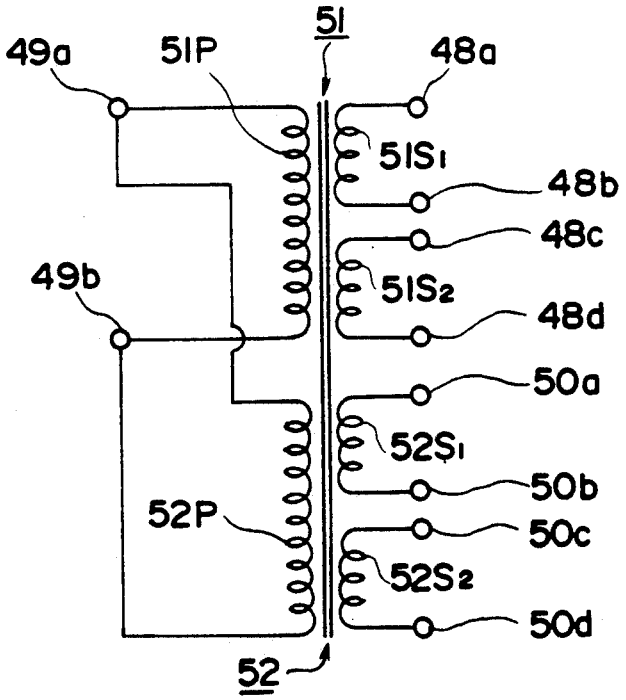

It is also possible to form each secondary winding from a plurality of separate windings as shown by FIG. 5 in which the secondary winding of the first coil 51 comprises a pair of windings $51S_1$, $52S_2$ and the secondary winding of the second coil 52 comprises a pair of windings $52S_1$, $52S_2$. In general, the present invention is implemented by an arrangement such that the respective primary windings are simultaneously energized and the respective secondary windings of the first coil 51 and the second coil 52 simultaneously provide respective outputs.

Figure 6:
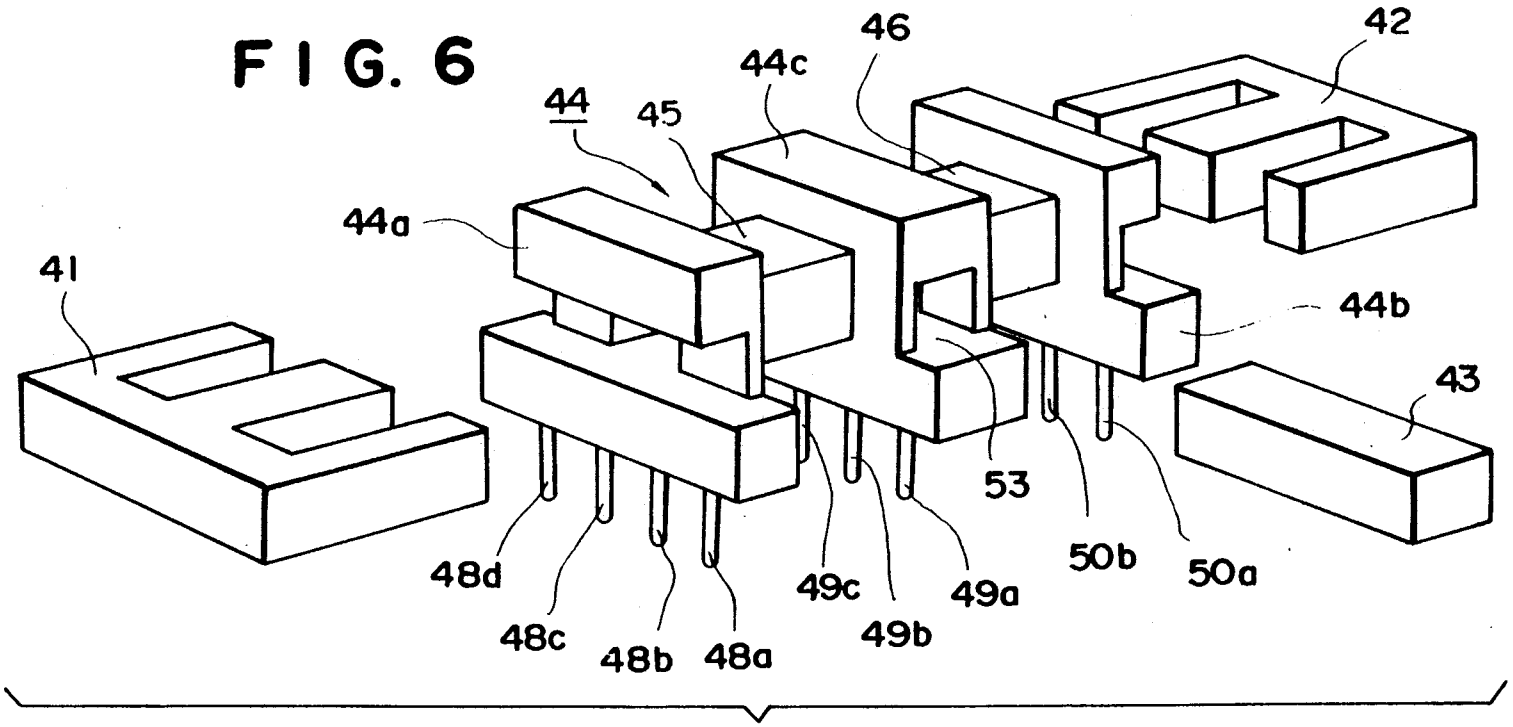
FIG. 6 is an exploded perspective view of a core/-bobbin assembly in a second embodiment of the transformer constructed according to the invention.

FIG. 6 is an exploded perspective view of a core/-bobbin assembly used in the second embodiment of the invention.

This embodiment is characterized by that the intermediate flange 44c is provided with a tunnel-like opening 53 longitudinally extending therethrough to receive the I-core element 43 but similar to the assembly for the first embodiment of the compact transformer as has been described, so far as the other aspects are concerned. Said opening 53 has a diameter substantially same as the plate width and the thickness of the I-core element 43 and side-to-side extends through the intermediate flange 44c, perpendicularly crossing the inner cavity of the square tubular portion.

The I-core element 43 is adhesively joined through said opening 53 to the respective E-core elements 41, 42 in the same manner as in the first embodiment.

Figure 7:
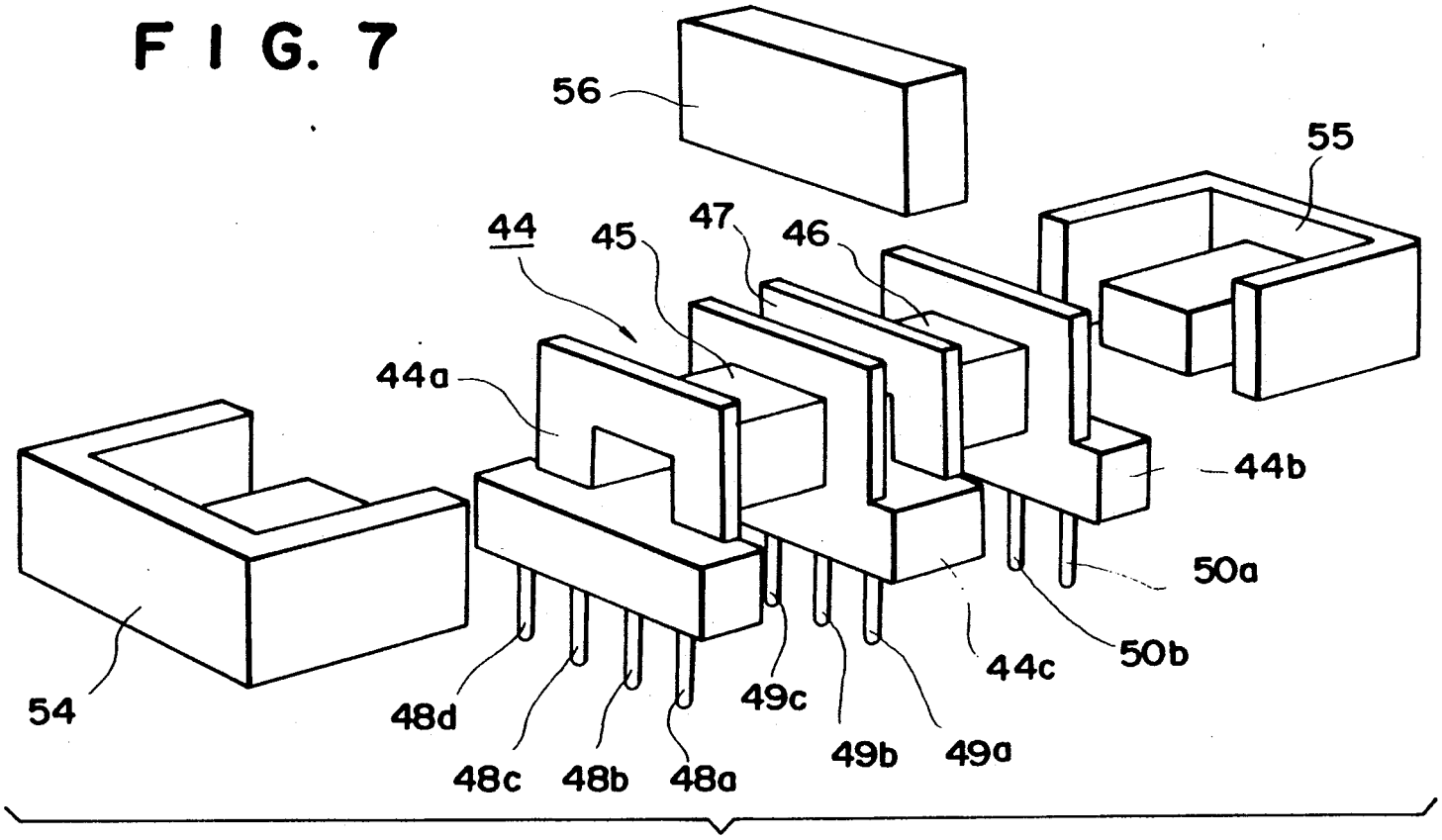
FIG. 7 is an exploded perspective view of a core/-bobbin assembly in a third embodiment of the transformer constructed according to the invention.
Figure 8:
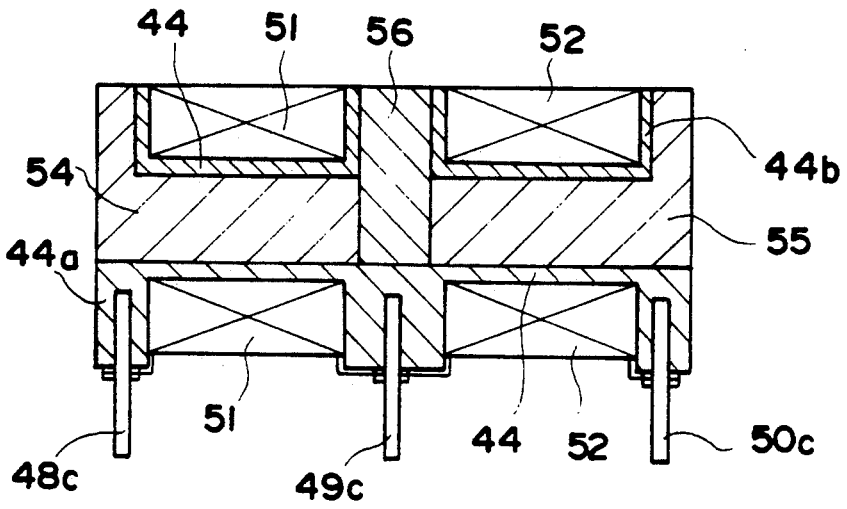
FIG. 8 is a vertical sectional view of the transformer constructed as the third embodiment of the invention.

FIGS. 7 and 8 illustrate the transformer constructed as a third embodiment of the invention.

The E-core elements 41, 42 in the preceding embodiments are configuration-modified into E-core elements 54, 55, respectively, in this embodiment. More specifically, each of these modified E-core elements 54, 55 has the side legs more spaced from each other than the side legs in the preceding embodiments are, and the central leg which is transversely prolonged in its vertical cross-section. The I-core element 56 is dimensioned in accordance with a spacing between the side legs of the respective E-core elements 54, 55.

Figure 9:
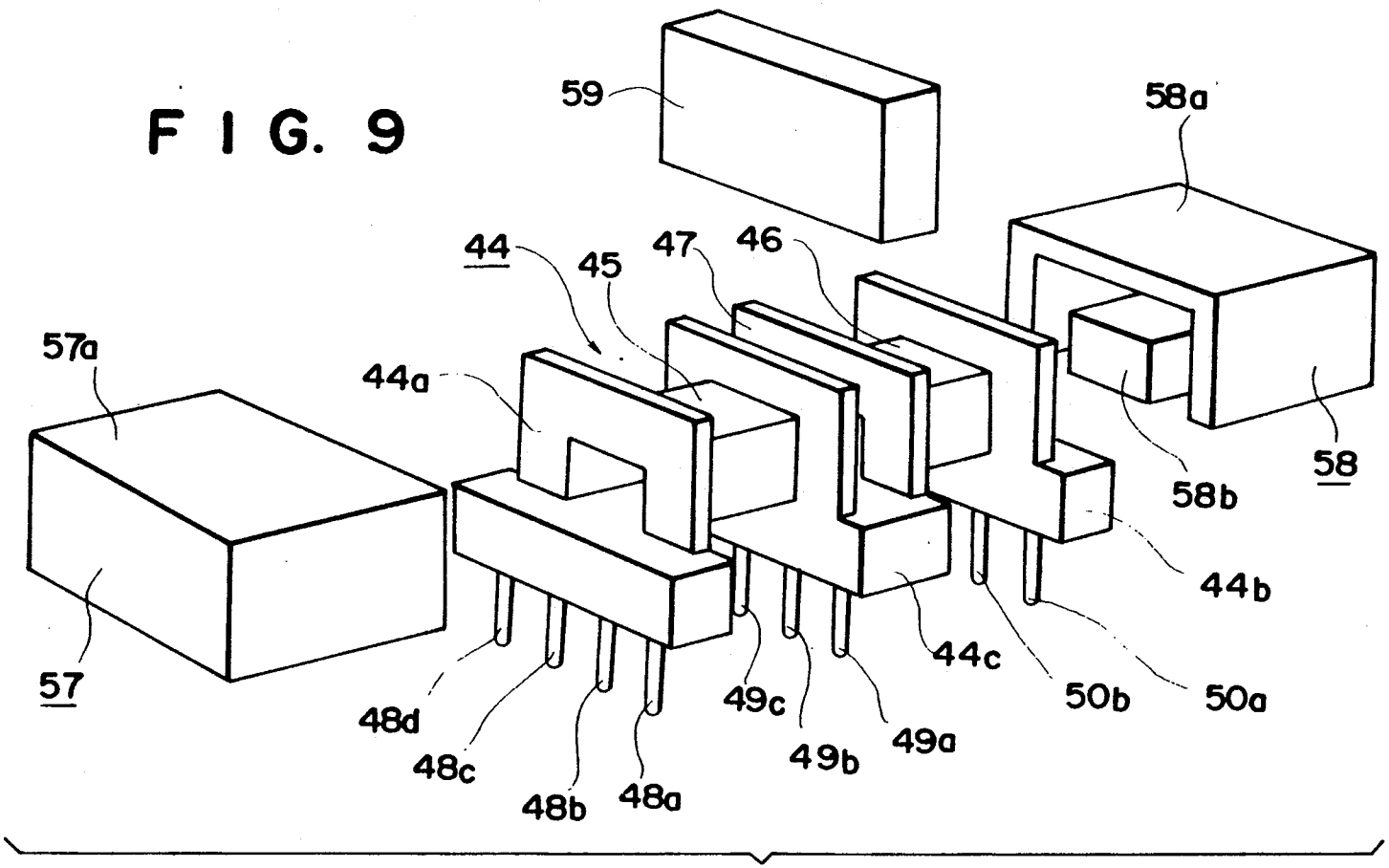
FIG. 9 is an exploded perspective view of a core/-bobbin assembly in a fourth embodiment of the transformer constructed according to the invention.
Figure 10:
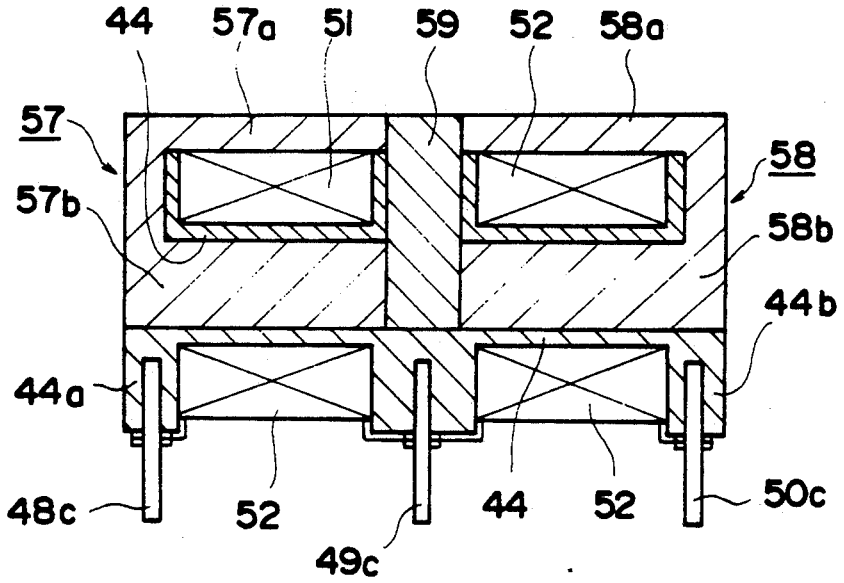
FIG. 10 is a vertical sectional view of the transformer constructed as the fourth embodiment of the invention.

FIGS. 9 and 10 show the compact transformer constructed as a fourth embodiment of the invention.

This embodiment is similar to the preceding embodiments except that one of the E-core elements in the preciding embodiments is replaced by a core element 57 comprising a combination of outer core element 57a/inner core element 57b and the other E-core element in the preceding embodiments is similarly replaced by a core element 58 comprising a combination of outer core element 58a/inner core element 58b. Said core elements 57, 58 are abutted and joined to the I-core element 59 sandwiched therebetween.

Figure 11:
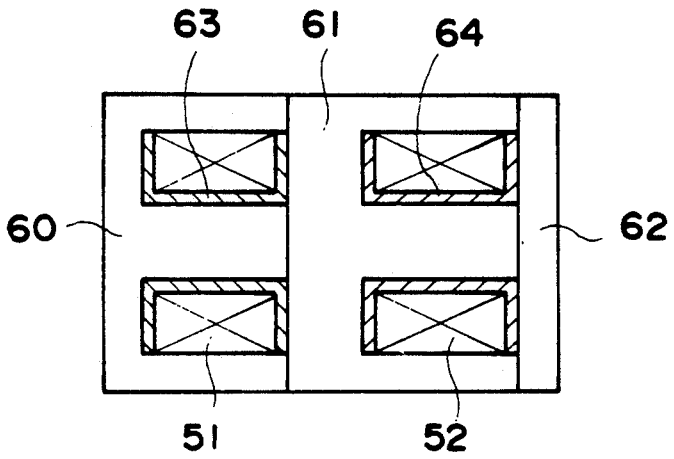
FIG. 11 is a horizontal sectional view of the transformer constructed as a fifth embodiment of the invention.
Figure 12:
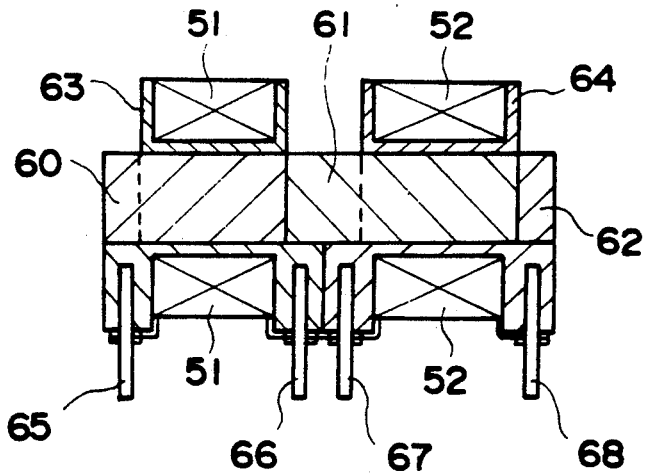
FIG. 12 is a vertical sectional view of said transformer constructed as the fifth embodiment.

FIGS. 11 and 12 show the compact transformer constructed as a fifth embodiment of the invention.

In this embodiment, respective leg end surfaces of one E-core element 60 are abutted and joined to a rear surface of the other E-core element 61 and respective leg end surfaces of the latter are abutted and joined to the E-core element 62. Specifically, the E-core element 60 is mounted on a bobbin 63 loaded with the first coil 51 and a combination of E-core element 61/I-core element 62 is mounted on another bobbin 64 loaded with the second coil 52. Thereafter the bobbins 63, 64 are integrally connected to each other and then the core elements 60, 61, 62 are successively abutted and joined to one another in the order of E-E-I.

When primary and secondary windings of the first coil 51 are connected to primary and secondary windings of the second coil 52, as shown by way of example in FIG. 4, the respective terminal pins 65, 66, 67, 68 may be directly connected to one another by suitable means or indirectly connected to one another by circuit wiring of a print substrate on which the compact transformer is installed.

Figure 13:
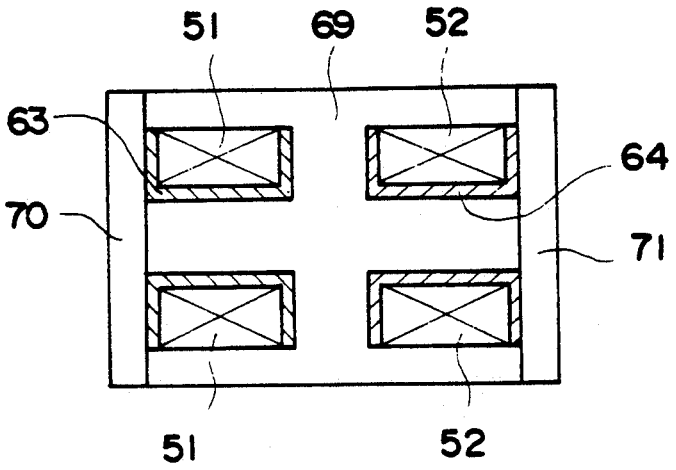
FIG. 13 is a horizontal sectional view of the transformer constructed as a sixth embodiment of the invention.
Figure 14:
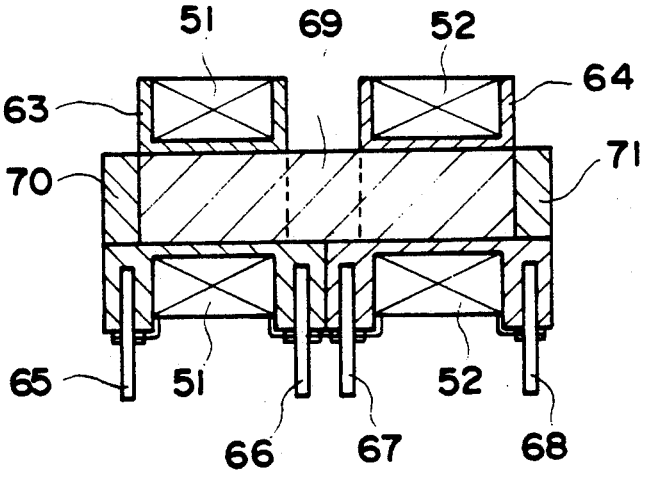
FIG. 14 is a vertical sectional view of said transformer constructed as the sixth embodiment.

FIGS. 13 and 14 show the compact transformer constructed as a sixth embodiment of the invention.

This embodiment is similar to the fifth embodiment except that a pair of I-core elements 70, 71 are abutted and joined to a ⊥-shaped core element 69 so as to sandwich this core element 69 therebetween.

Figure 15:
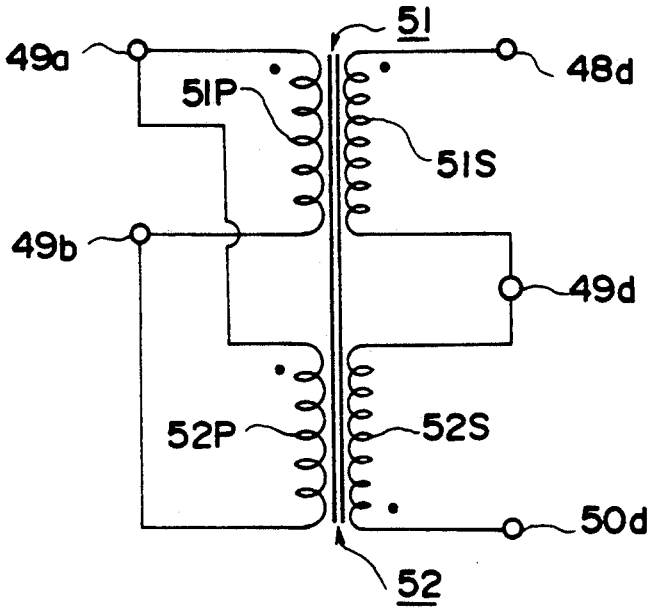
FIGS. 15 and 16 are diagrams respectively showing, by way of example, manners of coil loading in the transformer of the invention.

FIG. 15 is a circuit diagram of the transformer constructed according to the teachings of the invention similar to FIG. 4 except that, as indicated by dots, the leading end of the second coil 52 is somewhat modified. With the compact transformer of such design, operation of winding has conventionally been carried out according to a procedure in which, after the secondary winding 51S of the first coil 51 has been formed and the trailing end thereof has been anchored on the terminal pin 49d, further length of wire is not cut. The leading end of a new length of wire is anchored on the terminal pin 50d, then the secondary winding 52S of the second coil 52 is formed and finally the trailing end thereof is anchored on the terminal pin 49d.

In accordance with the present invention, however, the secondary winding 52S of the second coil 52 is formed, leaving further length of wire without being cut immediately after the secondary winding 51S of the first coil 51 has been formed and the trailing end thereof has been anchored on the terminal pin 49d. It should be noted here that the secondary winding 52S is formed in a reverse direction with respect to the secondary winding 51S of the first coil 51 and the trailing end thereof is anchored on the terminal pin 50d.

This is true also for the primary winding 52P of the second coil 52, i.e., after the primary winding 51P of the first coil 51 has been formed and the trailing end thereof has been anchored on the terminal pin 49b, a new length of wire is wound in a reverse direction with respect to the primary winding 51P to form the primary winding 52P of the second coil 52 and the trailing end thereof is anchored on the terminal pin 49a.

Figure 16:
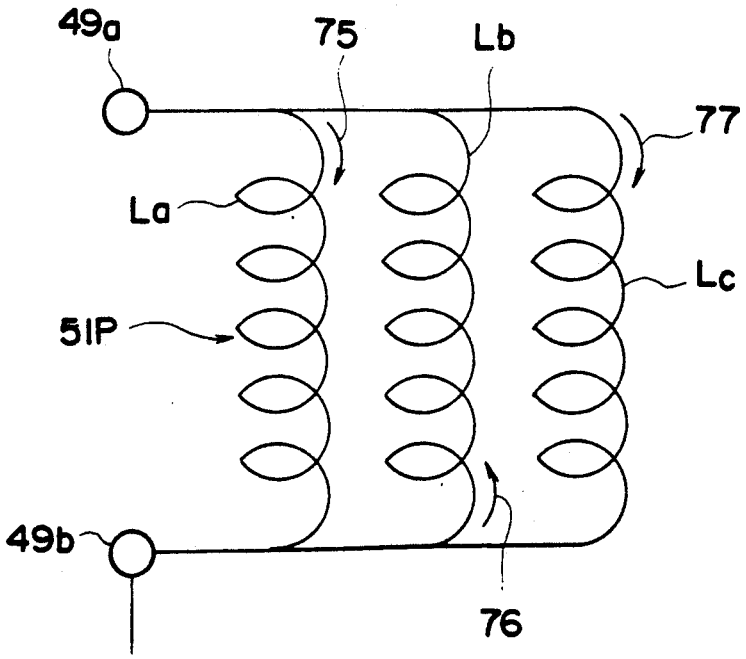

FIG. 16 is a diagram illustrating an alternative procedure to form the primary winding 51P of the first coil 51.

When the compact transformer is constructed as a boosting transformer, the primary winding 51P has usually been formed from wire which is thicker than that used for formation of the secondary winding 51S. However, the procedure illustrated by FIG. 16 allows both primary and secondary windings to be formed from wire of the same gauge.

Specifically, a length of wire of the same gauge as that used for the secondary winding 51S is provided. After the leading end has been anchored on the terminal pin 49*a*, a partial length of wire is wound in a direction as indicated by an arrow 75 to form a winding La and then the trailing end thereof is anchored on the terminal pin 49*b*. Immediately thereafter, another partial length of wire left without being cut is wound in a direction as indicated by an arrow 76 to form a winding Lb and the trailing end thereof is anchored on the terminal pin 49*a*, followed by winding further another partial length of wire left here again without being cut is wound in a direction as indicated by an arrow 77 to form a winding Lc and finally by anchoring the trailing end thereof on the terminal pin 49*b*.

The primary winding 51P formed in this manner comprises three sections of wire connected in parallel with one another and is equivalent to the winding formed from wire of a thicker gauge. The number of the sections to be parallelly connected is selective, depending upon the particular application.

The primary winding 52P of the second coil 52 also may be formed by the same procedure as has been mentioned above for the case of the primary winding 51P of the first coil 51.

Figure 17:
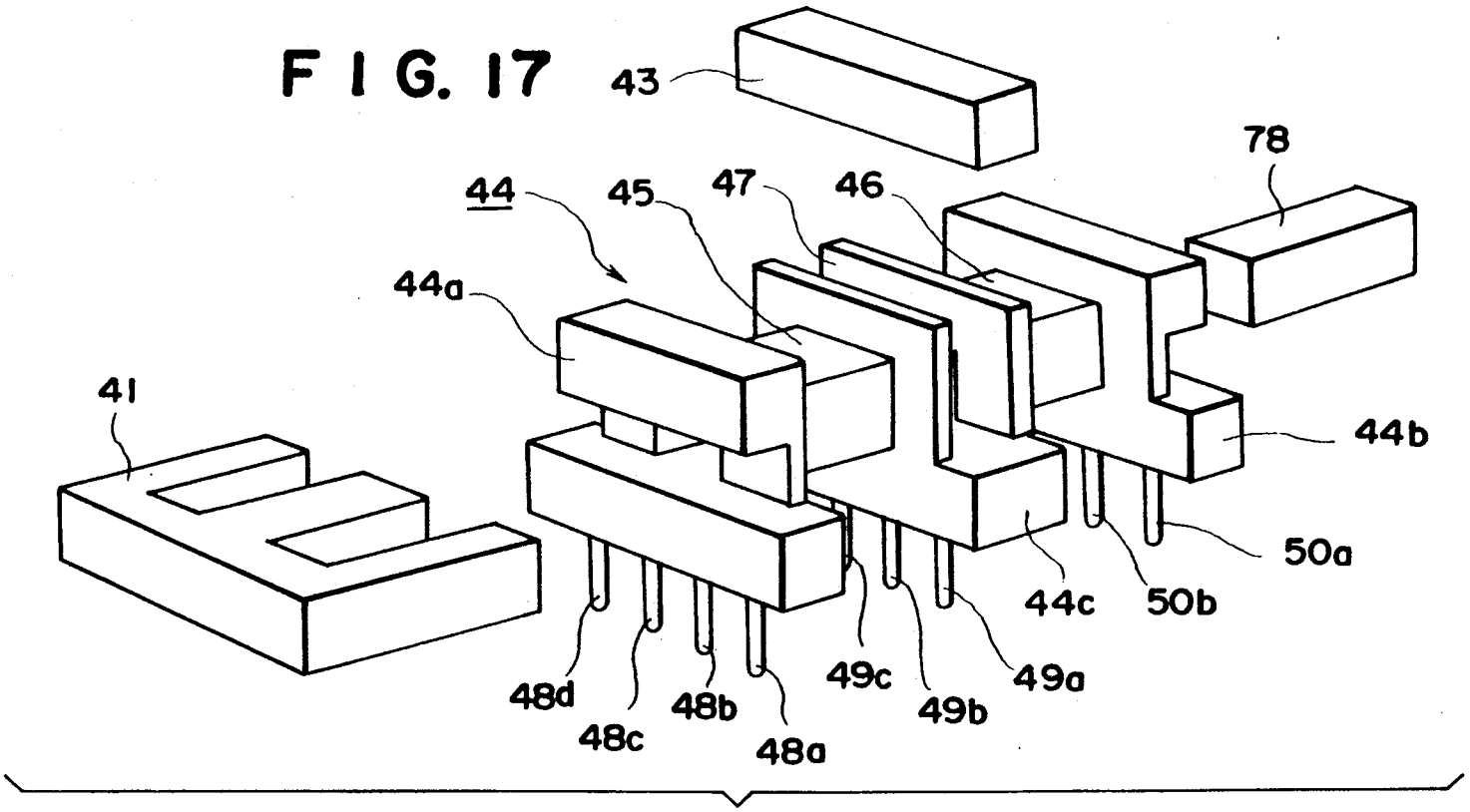
FIG. 17 is an exploded perspective view of a core/-bobbin assembly in the compact transformer as incorporated into a photographic flash discharge device.

FIG. 17 is an exploded perspective view of a specific core/bobbin assembly in the compact transformer used in a photographic flash discharge device.

This embodiment is similar to the first embodiment shown by FIG. 1 except that a prismatic core element 78 is inserted into the cavity of the second coil carrying section 46 defined along the bobbin 44. It should be understood that the core 78 is not necessarily required and the second coil carrying section 46 may be hollow.

Figure 18:
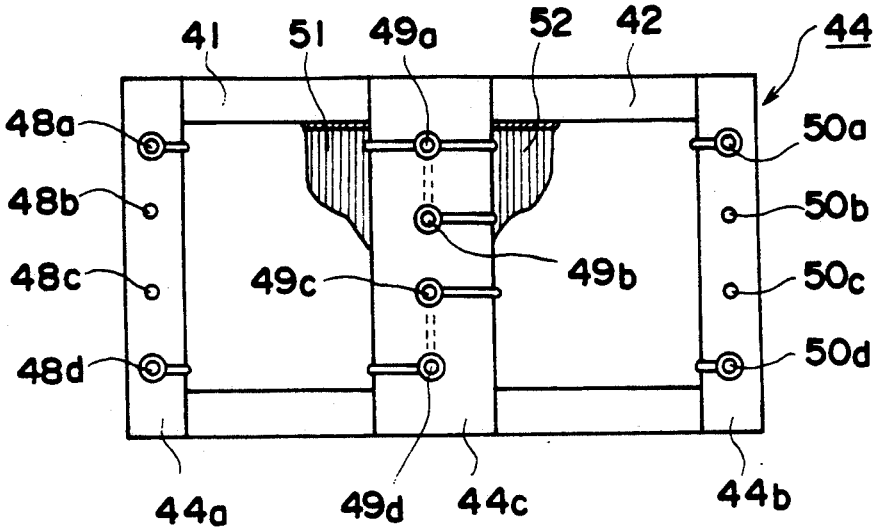
FIG. 18 is a bottom view of the compact transformer shown by FIG. 17.

A procedure of winding in this compact transformer will be discussed in reference with FIG. 18.

Once the leading end has been anchored on the terminal pin 48*d*, a partial length of wire is wound around the first coil carrying section 45 of the bobbin 44 to form the secondary winding 51S of the first coil 51 and the trailing end thereof is anchored on the terminal pin 49*d*, leaving another partial length of wire without being cut. After the leading end of this another partial length of wire thus left without being cut has been anchored on the terminal pin 49*c*, this length of wire is wound around the second coil carrying section 46 of the bobbin 44 to form the secondary winding 52S of the second coil 52 and the trailing end thereof is anchored on the terminal pin 50*d*.

The primary windings 51P, 52P also may be formed in the same manner as for the secondary windings 51S, 52S. Namely, after the leading end has been anchored on the terminal pin 48*a*, the primary winding 51P of the first coil 51 is formed and the trailing end thereof is anchored on the terminal pin 49*a*, leaving another length of wire without being cut. After the leading end of this length of wire has been anchored on the terminal pin 49*b*, the primary winding 52P of the second coil 52 is formed and the trailing end thereof is anchored on the terminal pin 50*a*. The respective portions of wire anchored on the associated terminal pins are fixed thereto by means of soldering and thereafter cutting of wire occurs between the terminal pins 49*a* and 49*b*, and between the terminal pins 49*c* and 49*d*.

Figure 19:
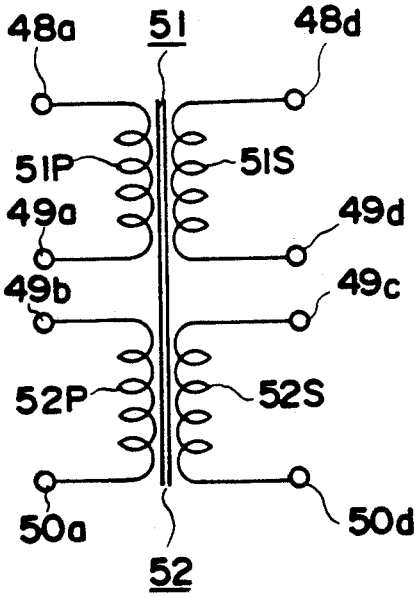
FIGS. 19 and 20 are diagrams respectively showing, by way of example, circuit arrangements which may be used in the transformer of FIG. 17.

FIG. 19 is a circuit diagram of the compact transformer constructed as has been mentioned just above. In the compact transformer, the first coil 51 serves as an oscillation transformer and the second coil 52 serves as a trigger transformer.

Figure 25:
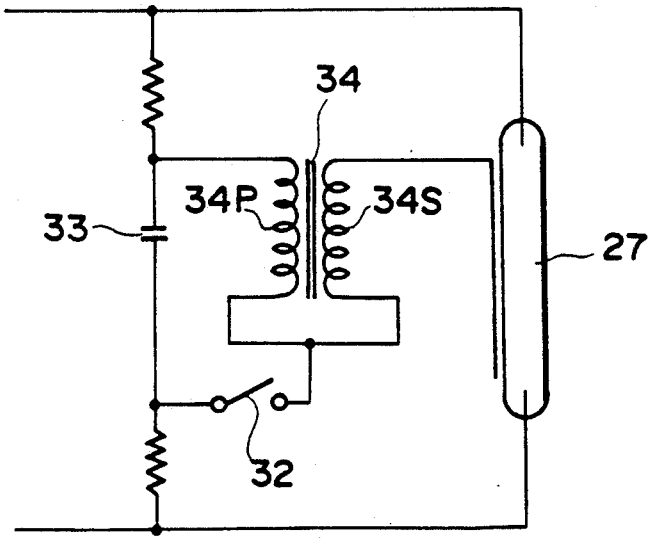
FIG. 25 PRIOR ART
FIG. 25 is a circuit diagram showing details of a trigger circuit in said flash discharge device.

The trigger transformer is usually constructed, as shown by FIG. 25, so that one end of the primary winding 34P and one end of the secondary winding 34S are drawn out as a common terminal.

Figure 20:
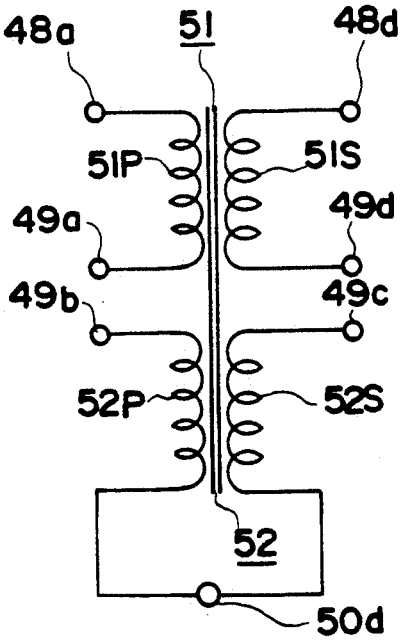

In the above-mentioned compact transformer, therefore, it is preferred that the primary winding 52P of the second coil 52 is anchored at the trailing end thereof on the terminal pin 50*d* and this terminal pin 50*d* is used as the common terminal so as to establish a circuit arrangement as shown by FIG. 20.

Figure 21:
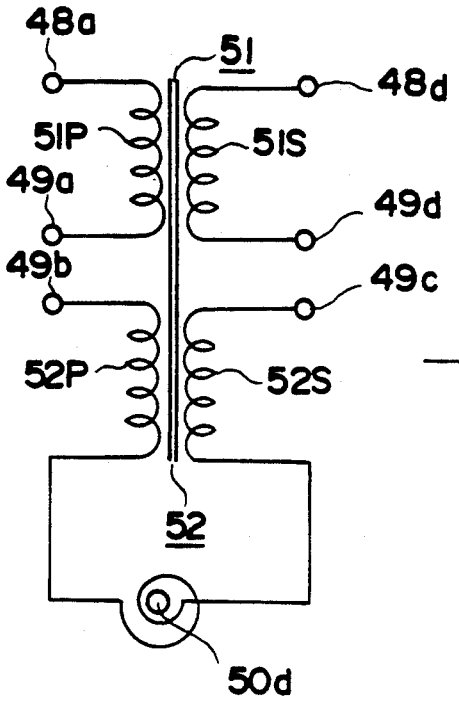
FIGS. 21 and 22 are diagrams respectively showing, by way of example, manners of coil loading in the transformer of FIG. 17.
Figure 22:
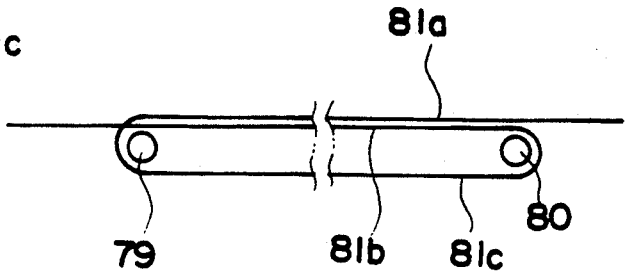
Figure 23:
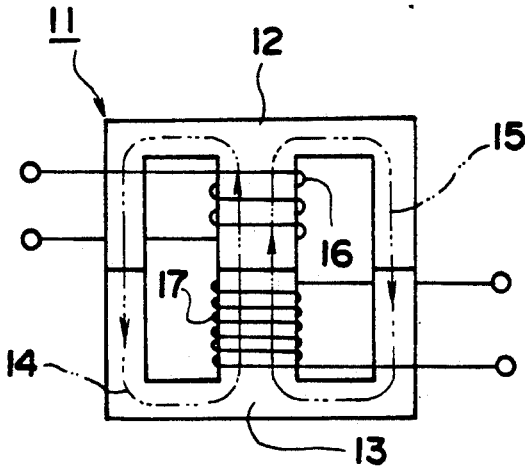
FIG. 23 PRIOR ART
FIG. 23 is a schematic diagram showing a compact transformer of prior art.
Figure 24:
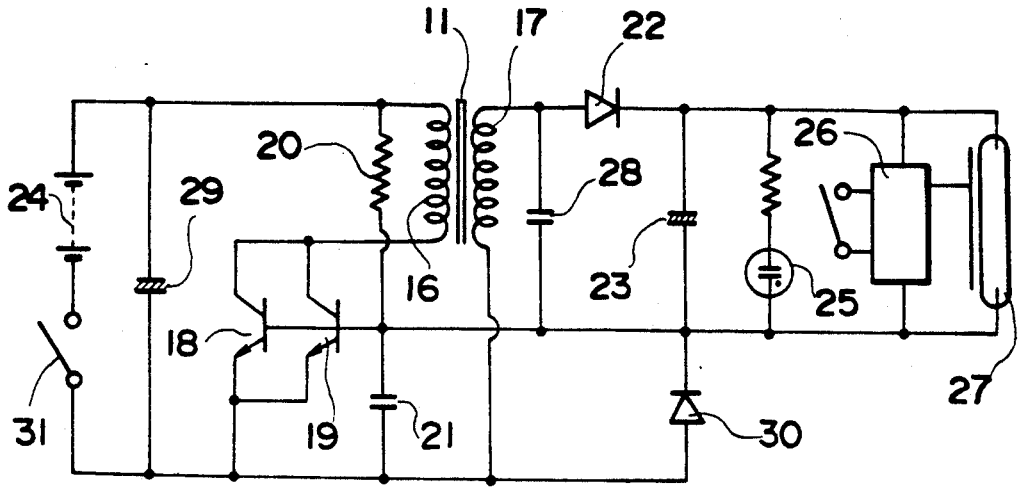
FIG. 24 PRIOR ART
FIG. 24 is a circuit diagram of an exemplary photographic flash discharge device utilizing the compact transformer.

FIG. 21 shows an embodiment of the compact transformer so constructed in accordance with the teachings of the invention that, after the secondary winding 51S of the first coil 51 and the secondary winding 52S of the second coil 52 have been formed in the manner as mentioned above, the primary winding 52P of the second coil 52 is formed by a continuous winding fashion, i.e., immediately before completion of the secondary winding 52S, a length of wire is folded back several times to obtain multiple-wire conductor of a predetermined length and then anchored on the terminal pin 50*d* as the trailing end of the secondary winding 52S, leaving said multiple-wire conductor without being cut. Then the primary winding 52P of the second coil 52 is formed from said multiple-wire conductor and the trailing end thereof is anchored on the terminal pin 49*b*. In such arrangement, the primary winding 51P of the first coil 51 is separately formed.

Alternatively, said primary winding 51P of the first coil 51 may be formed by, after the primary winding 52P of the second coil 52 has been formed and the trailing end thereof has been anchored on the terminal pin 49*b*, the leading end of said multiple-wire conductor is anchored on the terminal pin 49*a* and then the primary winding 51P of the first coil 51 is formed. In such case, cutting of wire occurs between the terminal pins 49*a* and 49*b*.

When the multiple-wire conductor is employed, a length of wire may be shuttled between a pair of catching pins 79, 80 being spaced from each other by a predetermined distance to obtain a plurality of wire sections 81*a*, 81*b*, 81*c* extending in parallel with one another and thereafter one of said catching pins 79, 80 may be turned to form multiple-wire stranded conductor.

What is claimed is:

1. A compact transformer, comprising:

first and second coils;

a core having a first closed magnetic circuit including a shared core element and a first E-shaped core element, the first E-shaped core element having a pair of side legs spaced in a first direction and a central leg arranged between the side legs, each of the side legs and the central leg defining a respective width in the first direction, and a second closed magnetic circuit including the shared core element and a second E-shaped core element, the second E-shaped core element having a pair of side legs spaced in the first direction and a central leg arranged between the side legs, each of the side legs and the central leg defining a respective width in the first direction, the width of the central leg of at least one of the first and second E-shaped core elements being substantially greater than the width of one of the side legs of the at least one E-shaped core element; and a bobbin having a first coil carrying section disposed around the central leg of the first E-shaped core element for carrying the first coil around the central leg of the first E-shaped core element, and a second coil carrying section disposed around the central leg of the second E-shaped core element for carrying the second coil around the central leg of the second E-shaped core element.

2. A compact transformer as recited in claim 1, wherein at least one of the first and second coils is constitutional by a length of wire forming a secondary winding and a primary winding, the wire having a portion between the secondary winding and the primary winding which is folded several times and anchored on a terminal pin.

3. The transformer of claim 1, wherein the respective legs of the first and second E-shaped core elements are generally rectangular in cross-section.

4. The transformer of claim 1, wherein the central and side legs of the first and second E-shaped core elements define respective heights in a second direction perpendicular to the first direction, the height of the side legs of at least one of the first and second E-shaped core members being substantially greater than the height of the central leg of the at least one E-shaped core member.

5. The transformer of claim 4, wherein the at least one E-shaped core member includes a wall leg generally parallel to the central leg, interconnecting the side legs, and abutting the shared core element.

6. The transformer of claim 1, wherein the bobbin defines a channel and the shared core element is associated with the channel.

7. The transformer of claim 1, wherein the bobbin comprises a plastic material.

8. The transformer of claim 1, wherein the first coil includes primary and secondary windings, the second coil includes primary and secondary windings, and inductive portions of the first and second coils are simultaneously activated.

9. The transformer of claim 1, wherein the first coil includes primary and secondary windings, the second coil includes primary and secondary windings, the primary winding of the first coils being connected to the primary winding of the second coil, and the secondary winding of the first coil being connected to the secondary winding of the second coil.

10. The transformer of claim 8, wherein the first coil carrying section comprises a first substantially square tubular portion having a first end flange integrally formed with one longitudinal end and a first intermediate flange integrally formed with the other longitudinal end, the first coil being wound substantially between the first end flange and the first intermediate flange; and the second coil carrying section comprises a substantially square tubular portion having a second end flange integrally formed with one longitudinal end and a second intermediate flange integrally formed with the other longitudinal end, the second coil being wound substantially between the second end flange and the second intermediate flange; whereby the first intermediate flange is arranged substantially adjacent to the second intermediate flange such that the first and second intermediate flanges define a channel, the central leg of the first E-shaped core element is inserted into the first substantially square tubular portion through the first end flange, the central leg of the second E-shaped core element is inserted into the second substantially square tubular portion through the second end flange, and the shared core element is inserted into the channel.

11. The transformer of claim 9, wherein the primary winding of the first coil comprises a first wire having a trailing end, the trailing end of the first wire being anchored by a first terminal pin such that a length of the first wire extends beyond the first terminal pin, the length of the first wire extending beyond the first terminal pin forming the primary winding of the second coil, the primary winding of the second coil including a trailing end anchored by a second terminal pin; and the secondary winding of the first coil comprises a second wire having a trailing end, the trailing end of the second wire being anchored by a third terminal pin such that a length of the second wire extends beyond the third terminal pin, the length of wire extending beyond the third terminal forming the secondary winding of the second coil; whereby the first and second coils operate as an integral transformer.

12. The transformer of claim 10, wherein the primary winding of the first coil comprises a first wire having a trailing end, the trailing end of the first wire being anchored by a first terminal pin such that a length of the first wire extends beyond the first terminal pin, the length of the first wire extends beyond the first terminal pin forming the primary winding of the second coil, the primary winding of the second coil including a trailing end anchored by a second terminal pin; and the secondary winding of the first coil comprises a second wire having a trailing end, the trailing end of the second wire being anchored by a third terminal pin such that a length of the second wire extends beyond the third terminal pin, the length of wire extending beyond the third terminal forming the secondary winding of the second coil; whereby the first and second coils operate as an integral transformer.

13. The transformer of claim 8, wherein the primary winding of the first coil comprises a first wire having a trailing end, the trailing end of the first wire being anchored by a first terminal pin such that a length of the first wire extends beyond the first terminal pin, the length of the first wire extending beyond the first terminal pin including a leading end and forming the primary winding of the second coil, the leading end of the length of wire extending beyond the first terminal pin being anchored by a second terminal pin; and the secondary winding of the first coil comprises a second wire having a trailing end, the trailing end of the second wire being anchored by a third terminal pin such that a length of the second wire extending beyond the third terminal pin, the length of wire extending beyond the third terminal including a leading end and forming the secondary winding of the second coil, the leading end of the length of the second wire extends beyond the third terminal pin being anchored by a fourth terminal pin; whereby a portion of the first wire between the first and second terminal pins is cut and a portion of the second wire between the third and fourth terminal pins is cut in order to allow the first and second coils to operate as separate transformers.

14. The transformer of claim 10, wherein the primary winding of the first coil comprises a first wire having a trailing end, the trailing end of the first wire being anchored by a first terminal pin such that a length of the first wire extends beyond the first terminal pin, the length of the first wire extending beyond the first terminal pin including a leading end and forming the primary winding of the second coil, the leading end of the length of wire extending beyond the first terminal pin being anchored by a second terminal pin; and the secondary winding of the first coil comprises a second wire having a trailing end, the trailing end of the second wire being anchored by a third terminal pin such that a length of the second wire extends beyond the third terminal pin, the length of wire extending beyond the third terminal including a leading end and forming the secondary winding of the second coil, the leading end of the length of the second wire extending beyond the third terminal pin being anchored by a fourth terminal pin; whereby a portion of the first wire between the first and second terminal pins is cut and a portion of the second wire between the third and fourth terminal pins is cut in order to allow the first and second coils to operate as separate transformers.

15. The transformer of claim 10, wherein the shared core element comprises an I-shaped core element adapted to abut and join the first and second E-shaped core elements.

16. A photographic flash discharge device, comprising:

an oscillation transformer component including a first coil, and a trigger transformer component including a second coil;

a core having a first closed magnetic circuit including a shared core element and a first E-shaped core element, the first E-shaped core element having a pair of side legs spaced in a first direction and a central leg arranged between the side legs, each of the side legs and the central leg defining a respective width in the first direction, and a second closed magnetic circuit including the shared core element and a second E-shaped core element, the second E-shaped core element having a pair of side legs spaced in the first direction and a central leg arranged between the side legs, each of the side legs and the central leg defining a respective width in the first direction, the width of the central leg of at least one of the first and second E-shaped core elements being substantially greater than the width of one of the side legs of the at least one E-shaped core element; and a bobbin having a first coil carrying section disposed around the central leg of the first E-shaped core element for carrying the first coil around the central leg of the first E-shaped core element, and a second coil carrying section disposed around the central leg of the second E-shaped core element for carrying the second coil around the central leg of the second E-shaped core element.

17. The photographic flash discharge device of claim 16, wherein the first coil includes primary and secondary windings, the primary and secondary windings of the first coil being wound around the first coil carrying section to form the oscillation transformer component; the second coil includes primary and secondary windings, the primary and secondary windings of the second coil being wound around the second coil carrying section such that one end of the primary winding and one end of the secondary winding are anchored to a common terminal pin to form the trigger transformer component; and inductive portions of the first and second coils are simultaneously activated.

* * * * *